United States Patent [19]

Hank et al.

[11] Patent Number: 4,793,564

[45] Date of Patent: Dec. 27, 1988

[54] DEVICE FOR CONTROLLING UNWINDING IN A WEB-FEEDING DEVICE OF A PRINTING MACHINE

[75] Inventors: Dietrich Hank, Leipzig; Reinhard Naumann, Delitzsch; Wolfgang Schneider, Leipzig, all of Fed. Rep. of Germany

[73] Assignee: Veb Kombinat Polygraph "Werner Lamberz" Leipzig, Fed. Rep. of Germany

[21] Appl. No.: 67,227

[22] Filed: Jun. 25, 1987

[30] Foreign Application Priority Data

Aug. 27, 1986 [DE] Fed. Rep. of Germany ..... 293880

[51] Int. Cl.[4] ..... B65H 59/00; B65H 20/24

[52] U.S. Cl. ..... 242/75.44; 226/118

[58] Field of Search ..... 242/75.44, 75.43, 75.45; 226/118, 119

[56] References Cited

U.S. PATENT DOCUMENTS 3,822,838 7/1974 Butler, Jr. et al. ..... 242/75.44

FOREIGN PATENT DOCUMENTS 0169476 7/1985 European Pat. Off. .

58849 4/1967 German Democratic Rep. .

*Primary Examiner*—Stuart S. Levy

*Assistant Examiner*—Steven M. DuBois

*Attorney, Agent, or Firm*—Michael J. Striker

[57] ABSTRACT

A device for controlling an unwinding of a continually fed material web in a printing machine comprises a web storage to which the web is loaded from the unwinding roller and which includes a housing-fixed roller group and a movable roller group. An inlet and an outlet rollers of the housing-fixed roller group are rotation-angle coupled with each other. The web storage serves as a control device for controlling the peripheral speed of the unwinding roller in dependence on the speed of the draw-in device.

2 Claims, 2 Drawing Sheets

DEVICE FOR CONTROLLING UNWINDING IN A WEB-FEEDING DEVICE OF A PRINTING MACHINE

BACKGROUND OF THE INVENTION:

The present invention pertains to a device for controlling the unrolling of the web in web-feeding devices provided with a web storage. Such a device can be preferably applied in a printing machine, particularly a rotary roller printing machine, in which the material web to be printed on is fed from a winding roller through a web storage of the printing machine with a constant and stable web tension.

Web-unrolling devices having a web storage with one group of rollers which are housing-fixed and are emptied or unloaded in the roller inoperative position and are then refilled, and another movable group of rollers have been known. A roller brake of the compensating roller in such devices is controlled and is arranged between the web storage and a web draw-in device, and the web unwinding takes place in dependence upon the web tension. Since speed fluctuations of the draw-in device or the unrolling roller affect the web tension, it has been proposed in EP-PS No. 169,476 that the effect of speed fluctuations would be prevented as early in operation as possible. In this device, depending on the change in the web tension the control system operates in response to measurements of the web in the draw-in device and the winding roller. However expenses resulting from the cascade-type control with receivers of reference and nominal values of the web tension and speed differences are considerable.

A substantial reduction of expenses is possible when the movable roller group of the web storage, in addition to its web-storing function can have the function of the reference value-transmitter for web speed changes. The disadvantage of such a device is that the deviation of the movable roller group of the web storage is proportional to the integral of the difference of the web speeds. The movable roller group of the web storage—of I-controller accordingly in the control system with the winding roller—or P-$T_1$—controller with a relatively great retardation tend to oscillate; these oscillations occur for a long time and do not decrease and can be changed within limits.

SUMMARY OF THE INVENTION

It is an object of the present invention to provide an improved device for controlling an unwinding process in a web-unwinding device of printing machines.

It is another object of the invention to provide a control device which would be inexpensive in manufacture and operation and reliable in use.

The present invention is based on the principle that an integral influence of speed fluctuations of the web draw-in device or the unwinding roller on the movable roller group should be prevented and thereby it should be ensured that speed fluctuations would not cause instability of the control with a change of the web tension and, on the other hand, in dependence upon the deflecting of the movable roller group of the web storage from the true path, the speed fluctuations and the changes in the web tension would be quickly controlled.

These and other objects of the invention are attained by a device for controlling an unrolling of a continually unwound material web in material web unwinding devices of printing machines comprising an unwinding roller with a roller brake; and a web storage including a housing-fixed roller group with rollers unloadable in an inoperative position and then loadable again, and a movable roller group, wherein said movable roller group, upon unloading of said web storage is braked by a braking force against an advancing force exerted on said movable roller group by a web tension and for loading said web storage is displaced opposite to the direction of said housing-fixed roller group by an advancing force exerted on said movable roller group, and with a loaded web storage to roller brake is controlled in dependence upon a deviation of said movable roller group, two rollers of said roller groups of said web storage being rotation-angularly coupled to each other by a drive uncoupled during the unloading of said web storage, said drive having such a transmission ratio that peripheral speeds of said coupled rollers are the same.

Said two rollers may be outlet and inlet rollers of said housing-fixed roller group.

The coupled rollers act as web-feeding rollers which are driven preferably over the material web to be printed without a further transmission means by the draw-in device.

The drive for coupling the rotation angle between the first roller and the second roller can be, for example a gear or pulling means drive.

For uncoupling of the drive during the unloading of the web storage, a force-locking and slippage-free coupling is provided.

Speed differences occurring between the draw-in device and the unrolling roller cause changes in an elastic expansion of the material web portion between the unrolling roller and the first coupled roller, as viewed in the direction of running of the web material, and the first roller and the second roller of the web storage. In the material web path, in which the web is loaded by the movable roller group with the force which corresponds to the nominal value of the web tension in the printing machine, a compensation for that tension takes place Since the material web, due to the tension compensation, is fed by the second coupled roller with the same speed as that of the first coupled roller the movable roller group is pivoted from its rest position. The amount of pivoting or deviation is proportional to the intergral of the expansion change of the web portion between the unrolling roller and the first coupled roller and also, with a considerably small integral transmission factor, to the integral of the change of the web speed of the draw-in device. The movable roller group of the web storage serves thereby in the advantageous manner as a control device with the integral ratio and a relatively small transmission factor. The housing-fixed roller group of the web storage represents by means of the coupling a transmission member with the proportionally acting influence of the speed fluctuations of the draw-in device or the unwinding roller. The changes of the elastic expansion of the web portion between the unwinding roller and the first coupled roller, as viewed in the direction of running of the web, which changes are derived from the changes in speeds, are effective immediately on the unwinding roller as a torque with a respective tension force.

The web storage is therefore a control device for controlling a peripheral speed of the unwinding roller in dependence upon the speed of the printing machine, which speed has the transmission ratio with the I-component and P-component. Tee unwinding roller represents the place of action for the sum of the transmission ratios.

Upon reaching of the given minimal diameter of the unwinding roller a roller exchange is induced with the braking of the unwinding roller. During the braking and when the roller is at the rest position, the web storage is unloaded with the force corresponding to the nominal value of the web tension in the machine with the braked motion of the movable roller group of the web storage, in the direction towards the housing-fixed roller group under the influence of the web tension. At this period of time, the drive for coupling the rollers to each other is disconnected, and the control chain between the movable roller group of the web storage and the roller brake is interrupted by the switch.

The critical point of the invention is the use of the arrangement according to DD-PS No. 58 849 which discloses a compensating roller arrangement in which the compensating roller is arranged between two feeding rollers which are driven by the drive of the printing machine with the same peripheral speed. The specific effect or this arrangement resides in that the compensating roller arrangement in connection with the braked unwinding roller corresponds to the parallel switching of the element and the unwinding roller serves as a place for the sum of the ratios while the web storage operates as a control device for controlling the unwinding of the web in the web-unwinding or web-feeding devices for a long time (more than 15 years). The satisfactory development of the arrangement and its functional connection with the web storage provides for unexpected results.

A further advantage of this invention resides in that not only a stable control of tee unwinding process of the material web is obtained but also, during the filling of the web storage the movement of the movable roller group of the web storage is braked without any special means before they reach the end position. The specific economical effect of the invention is obtained because the stable control is provided by simple means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 2:
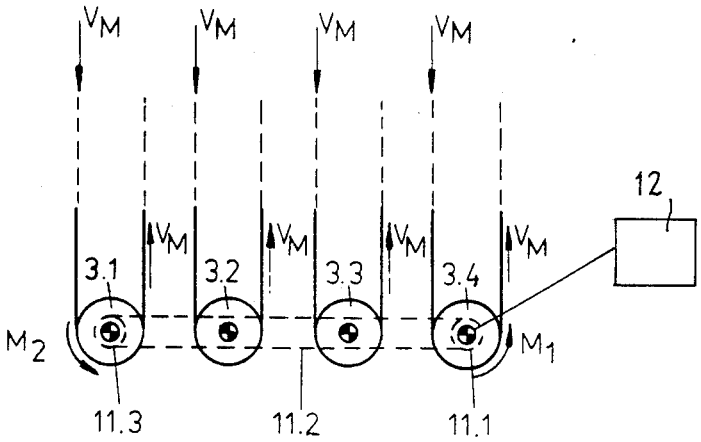
FIG. 2 is a schematic view of the housing-fixed roller group of the web storage with a web tension means drive, according to the invention.
Figure 3:
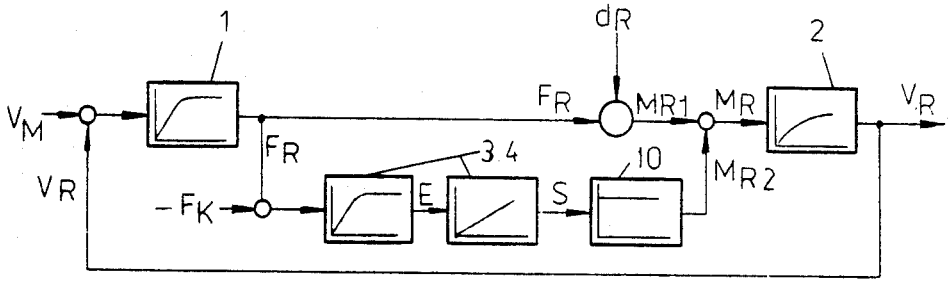
FIG. 3 is a flow chart diagram of the control system (with individual transition functions) for controlling the web unwinding process.

Referring now to the drawings in greater detail it will be seen that reference numeral 3 designates a stationary or housing-fixed roller group of the web storage. Reference numeral 2 designates a web-unwinding or unrolling roller. Outlet and intlet rollers 3.4, 3.1 of the roller group 3 are angular rotation-coupled with a pulling means 11.2 and a driven gear 11.3 (as shown in FIG. 2) by a pulling means drive 11 disengaged during the unloading or emptying of the web storage and comprising a drive gear 11.1. The pulling means drive 11 has such a translation ratio that the peripheral speed of the inlet roller 3.1 is approximately equal to the peripheral speed of the outlet roller 3.4. The rollers 3.1 and 3.4 coupled with one another are driven by a draw-in device 5 as web-conveying rollers which are preferably connected via the paper web 1, without a further translation means, for example the translation drive for the translation of the torque from a pulling or draw-in device 5 to the rollers 3.4 and 3.1.

For the uncoupling of the pulling means drive 11 during the emptying of the web storage, a force-locking and slippage-free shifting coupling (non-shown) is provided. The occurring speed differences between the draw-in device 5, by means of which the paper web is fed in the printing machine with a changeable speed, and the roller 2, cause changes in an elastic expansion of the web portion between the roller 2 and the inlet roller 3.1, and this expansion is transmitted in the web path between the inlet roller 3.1 and the outlet roller 3.4 of the web storage in which the paper web 1 is loaded by the roller group 4 of movable rollers (FIG. 1) with the force Fk, which corresponds to the reference value of the web tension in the printing machine and results in an expansion compensation. Inasmuch as the paper web 1 after the resulting compensation for its expansion is further conveyed from the outlet roller 3.4 with the same speed that of the inlet roller 3.1 the movable roller group 4 will be deviated from their rest position. This deviation from the rest position is proportional to the intergral of the expansion change in the material web portion between roller 2 and the inlet roller 3.1 and thereby, also with a considerably small translation factor, to the integral of the change of the web speed $V_M$ of the web-drawing device 5.

Figure 1:
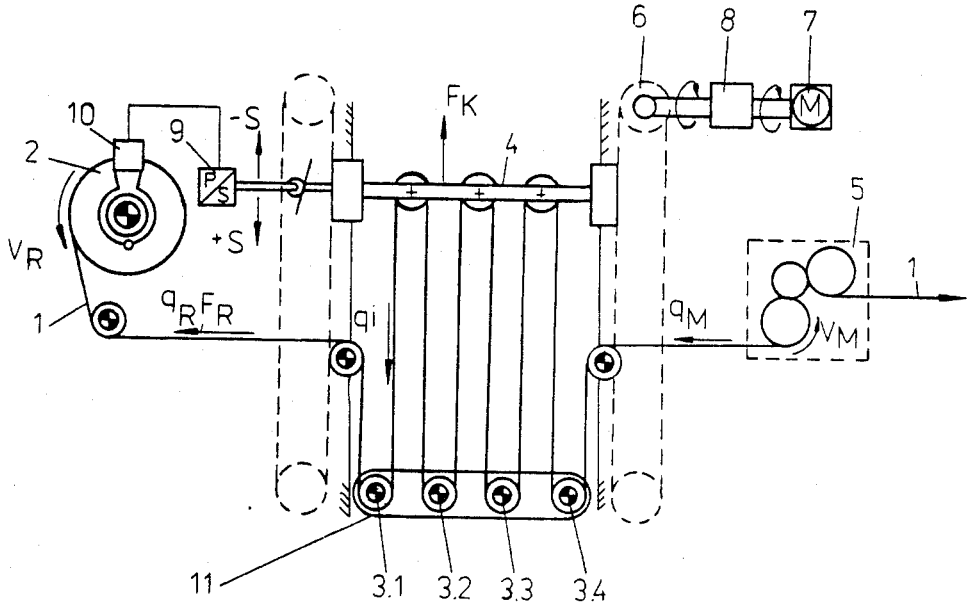
FIG. 1 is a schematic representation of the material web feeding device with a web storage and a web-pulling device.

Electric motor 7 is connected to a coupling 8, which may be an induction coupling, which in turn is connected to a chain wheel 6 of a chain shown in FIG. 1 by broken line. When the web storage is emptied the movable roller group 4 is braked by braking force relative to the immovable roller group against the direction of the advancing force exerted on the immovable roller group. This braking force directed upwardly in FIG. 1 is originated by the drive torque of motor 7 and the maximal translation torque of the coupling 8.

When the web storage is loaded the movable roller group is displaceable by drive force $F_K$ from the housing-fixed roller group. This drive force $F_K$ is also originated by the drive torque of motor 7 and the translation torque of induction coupling 8. Motor 7 runs continually that is during the emptying and the loading of the web storage as well, and without changing the direction of rotation thereof.

The movable roller group 4-of the web storage serves in the advantageous manner as a control device with the integral action and a relatively small integral transmission factor. The housingfixed roller group 3 of the web storage represents by the coupling of the inlet roller 3.1 and outlet roller 3.4, a transmission member with a proportional influence of speed fluctuations of the web-drawing device 5 on the roller 2. The changes in the elastic expansion of the web portion between the roller 2 and the inlet roller 3.1, which changes are caused by the speed fluctuations, take effect immediately on the roller 2 as a torque $M_{R1}$ with a corresponding expansion force $F_R$.

The web storage is thereby a control device for controlling a peripheral speed VR of the unwinding roller 2 in dependence upon the web speed $V_M$ of the web-drawing device 5, the transmission action of which has an I-component and a P-component. Roller 2 represents an effective position for the sum of the transmission components.

The control device includes in addition to the movable roller group 4, a path-pressure-transformer 9 and a roller brake 10.

Upon reaching of a given minimal roller diameter $d_R$ the roller 2, with the braking of this roller, is fed into the roller exchange device (conventional and non-shown). During the braking and in the inoperative or stationary position of the roller 2, the web storage is emptied by a braking motion of the roller group 4 with a constant web force Fk corresponding to the reference value of the web tension in the printing machine in the direction towards the housing-fixed roller group 3 of the web storage under the influence of the web tension. The pulling means 11 for coupling the angle of rotation of the outlet roller 3.4 and the inlet roller 3.1 is at this time period uncoupled, and the control chain between the movable roller group 4 of the web storage and the roller brake 10 is interrupted.

It is believed to be understood that the pulling means 11, or in other words the drive means which couple the rollers 3.1 and 3.4 is of a conventional construction and can be formed such as an existing conventional clutch. An uncoupling element for uncoupling the drive means is also a conventional element for uncoupling such a clutch and it is identified with reference numeral 12 in FIG. 2 of the drawings.

It will be understood that each of the elements described above, or two or more together, may also find a useful application in other types of devices for controlling web unrolling in feeding devices differing from the types described above.

While the invention has been illustrated and described as embodied in a device for controlling web unrolling in a web-feeding device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for controlling an unrolling of a continually unwound material web in material web unwinding devices of printing machines, comprising an unwinding roller with a roller brake; a web storage including a housing-fixed roller group with a plurality of rollers unloadable in a stand still position and loadable again, and a movable roller groups, wherein said movable roller group, upon emptying of said web storage is biased by a biasing force means against an advancing force exerted on said movable roller group by a web tension, and for loading said web storage, is displaced opposite to the direction of said housing-fixed roller group by an advancing force exerted on said movable roller group; and means for controlling the roller brake in dependence upon a deviation of said movable roller group, the improvement comprising drive means which couple two rollers (3.1, 3.4) of said housing-fixed roller groups of said web storage so that peripheral speeds of said coupled rollers (3.1, 3.4) are the same; and means to uncouple said drive means during the emptying of said web storage.

2. The device as defined in claim 1 wherein said two rollers are outlet and inlet rollers (3.4, 3.1) of said housing-fixed roller group.

* * * * *